US005350234A

United States Patent [19]

Hagen

[11] Patent Number: 5,350,234

[45] Date of Patent: Sep. 27, 1994

[54] PROCESS FOR CONTINUOUSLY MIXING TWO OR MORE MATERIALS WITH NON-PULSATING MIXING AND FILLING STORAGE CONTAINERS

[75] Inventor: Peter Hagen, Harbor Springs, Mich.

[73] Assignee: Dow Corning Corporation, Midland, Mich.

[21] Appl. No.: 184,370

[22] Filed: Jan. 21, 1994

[51] Int. Cl.[5] ..... B01F 15/04; B01F 15/02

[52] U.S. Cl. ..... 366/162; 366/19; 366/76; 366/192

[58] Field of Search ..... 366/161, 162, 76, 97, 366/98, 16, 17, 19, 131, 150, 152, 154, 160, 176, 177, 181, 184, 192; 425/207, 208, 209

[56] References Cited

U.S. PATENT DOCUMENTS

| | | | |
|---|---|---|---|
| 2,847,196 | 8/1958 | Franklin | 366/161 |
| 2,894,732 | 7/1959 | Taber | 366/162 |
| 3,067,987 | 12/1962 | Ballou | 366/161 |
| 4,473,299 | 9/1984 | Guibert | 366/76 |
| 4,765,745 | 8/1988 | Strecker | 366/76 |
| 4,818,113 | 4/1989 | Patel | 366/76 |

*Primary Examiner*—Robert W. Jenkins
*Attorney, Agent, or Firm*—Roger H. Borrousch

[57] ABSTRACT

A process for continuously without pulsation mixing at least two pumpable materials to produce a homogeneous product which is constant throughout the operation. Contents of material suppliers are pumped to a dynamic mixer through a pulsate eliminator where the dynamic mixer is a low pressure mixer and exude leaving the dynamic mixer passes through a multi-way valve and storage container are filled.

6 Claims, 3 Drawing Sheets

PROCESS FOR CONTINUOUSLY MIXING TWO OR MORE MATERIALS WITH NON-PULSATING MIXING AND FILLING STORAGE CONTAINERS

BACKGROUND OF THE INVENTION

1. Field of the Invention

This invention relates to a process for continuously mixing two or more pumpable materials and filling storage containers.

2. Background Information

It is often necessary to make small modifications to generic types of consumer and industrial elastomeric products, in order to maximize their utility for specific applications or to customize them for individual preferences. This can be accomplished for many products by altering their formulation ratios, adding new ingredients, or removing ingredients. While this capability to flexibly provide families of products is desirable, it can add equipment and operating costs which are not easily passed on to the customer.

Many elastomeric compositions are produced in capital intensive processes, employing sophisticated mixing devices which provide high shear for dispersion of reinforcing and extending fillers into polymeric liquids. These devices are not easily cleaned or changed over from product to product. Large amounts of waste and considerable downtimes are the result. Some types of product variations needed include addition of pigments, polymers, adhesion promoters, fungicides, rheology controllers, plasticizers, crosslinkers, cure catalysts, cure inhibitors or other additives used in the art of elastomers, which includes sealants, rubber, and other elastomer compounds. It is preferred to manufacture this range of products with processes outside of those which use sophisticated high shear devices.

SUMMARY OF THE INVENTION

An object of this invention is to provide the capability to produce and package many elastomeric products with minimal waste, minimal energy, and low cost while delivering them continuously, homogeneously, and without pulsations.

This invention relates to a process comprising continuously displacing with pulsating movement created by a force means from at least two material suppliers, pumpable feed material from each material supplier through respective pulsate eliminators into a dynamic mixer having an input end and an exit end wherein the pressure at the input end is less than 3.5 MPa, and thereby continuously combining at least two pumpable feed materials in a predetermined volume ratio to provide a thoroughly mixed product which is being continuously exuded from the exit end of said dynamic mixer at a constant volume flow and said product exiting the dynamic mixer being of constant composition throughout the time the process is operated given the pumpable feed materials are constant and the predetermined volume ratio of pumpable feed materials is constant, continuously passing the mixed product exude from the exit end of the dynamic mixer through a multi-way valve attached to the exit end of the dynamic mixer, and filling storage containers.

BRIEF DESCRIPTION OF THE DRAWINGS

Description of the Figure

Figure 1:
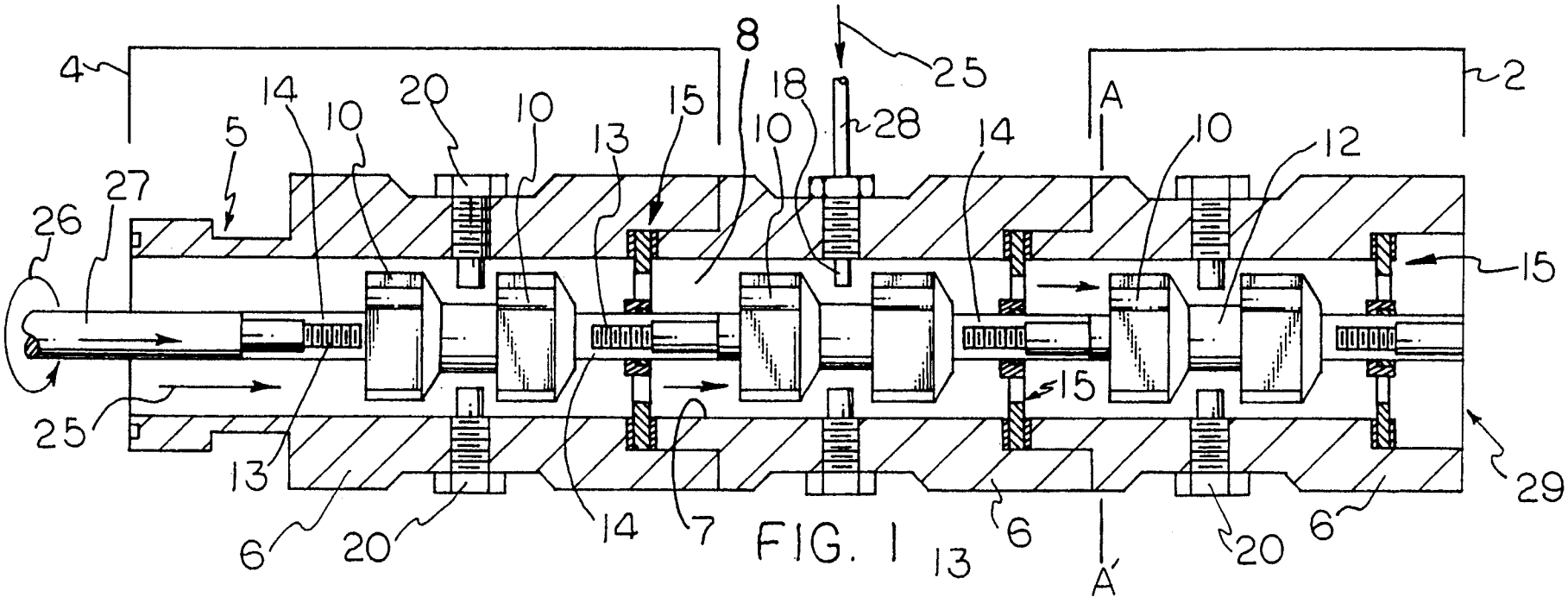

FIG. 1 is a partial cross section of two connected disconnectable mixing units and an end disconnectable mixing unit of a dynamic mixer.

Figure 2:
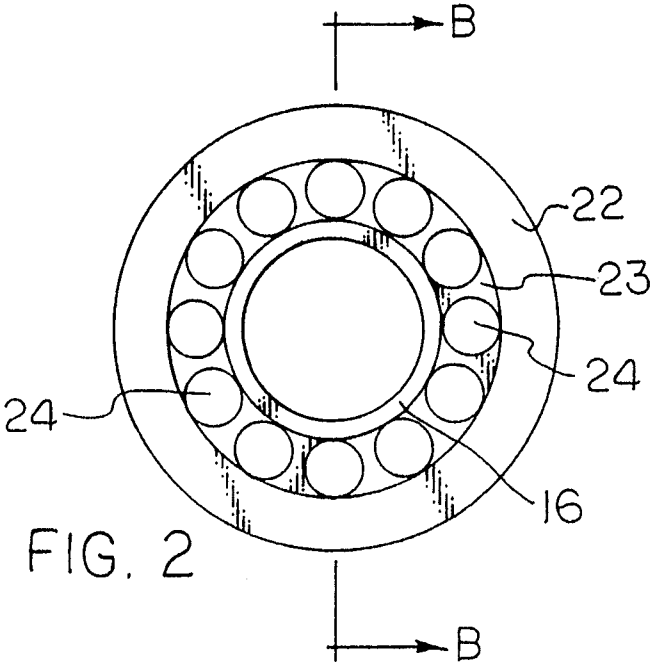

FIG. 2 is an end view of a bulkhead assembly.

Figure 3:
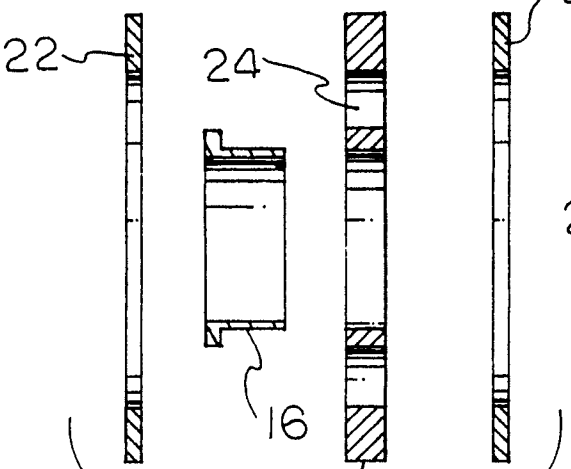

FIG. 3 is an exploded cross section of the bulkhead assembly of FIG. 2 at B—B'.

Figure 4:
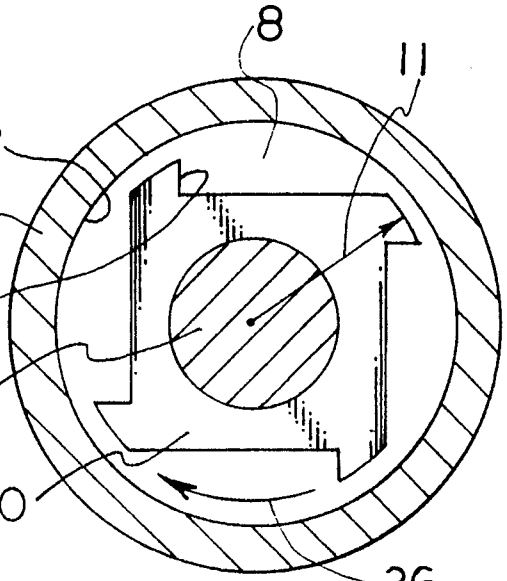

FIG. 4 is a cross section at A—A' of a disconnectable mixing unit showing the flywheel configuration.

Figure 5:
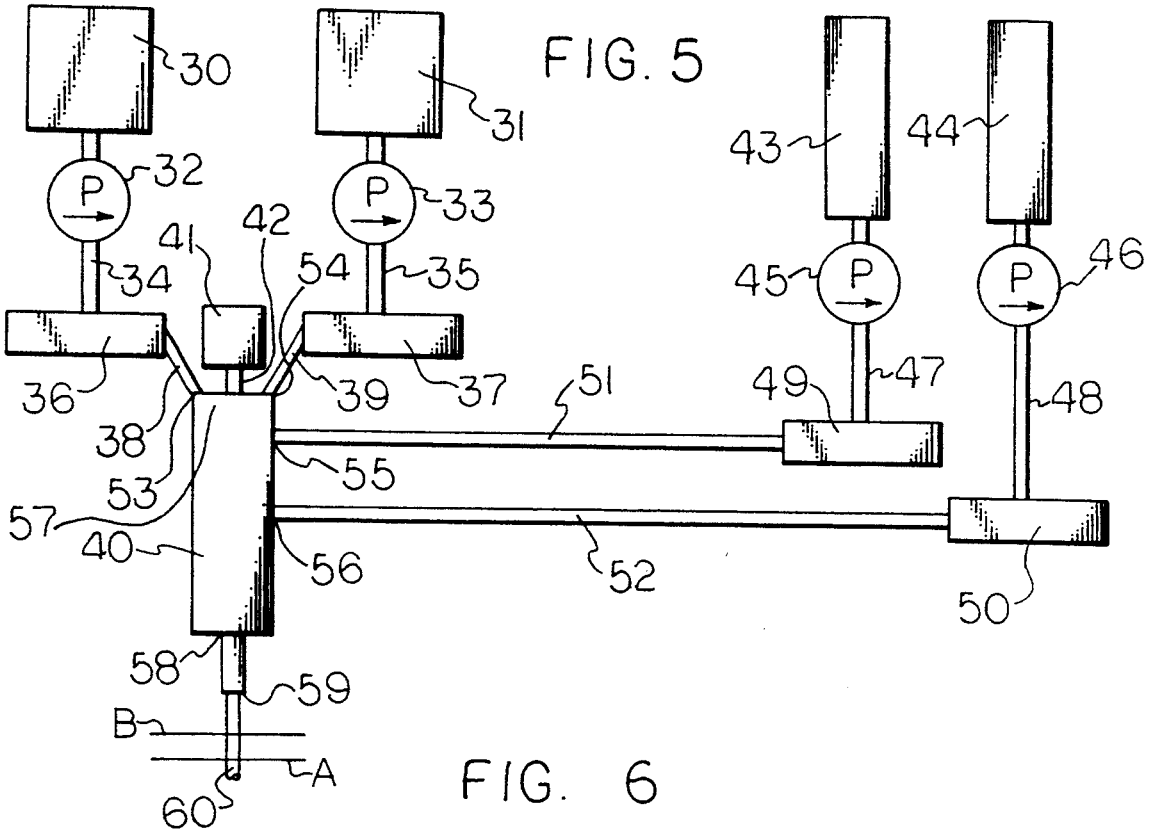

FIG. 5 is a schematic of the process showing how the equipment and the process function to provide a non-pulsating product exude.

Figure 6:
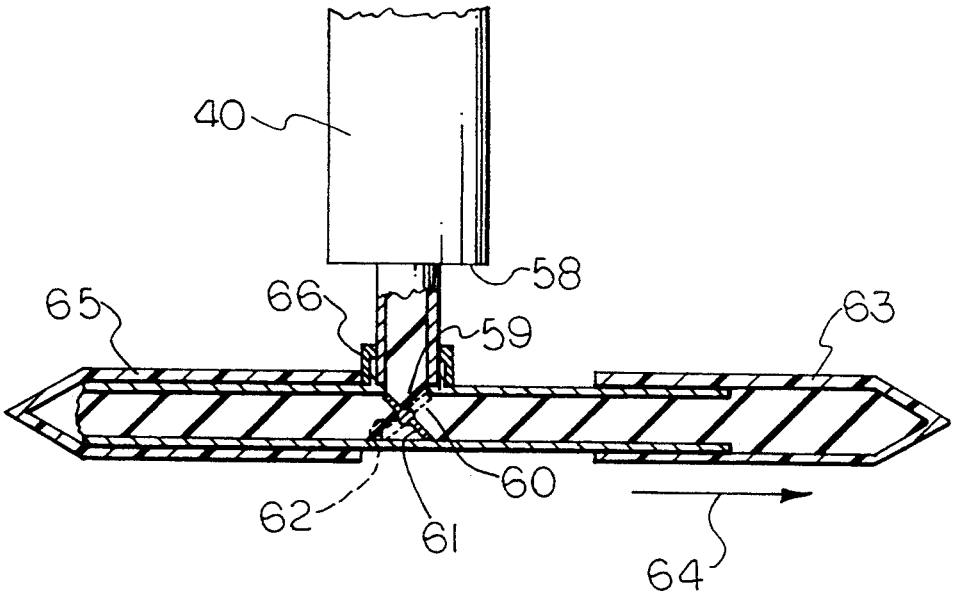

FIG. 6 is a schematic of the filling process illustrating a three-way butterfly valve in a partial cross section.

List of Reference Numbers and Description

2—disconnectable mixing unit
4—end disconnectable mixing unit
5—connection flange
6—casing
7—chamber wall
8—chamber
10—flywheel
12—spindle
13—male threaded spindle fastener
14—female threaded spindle fastener
15—bulkhead assembly
16—spindle bushing
18—inlet port
20—post
21—folding recess
22—washer
23—bulkhead
24—bulkhead perforation
25—direction of material flow
26—rotational direction of spindle
27—spindle driver
28—feed line
29—material exit end
30—first material supplier
31—second material supplier
32—first pump means
33—second pump means
34—feed line from first material supplier
35—feed line from second material supplier
36—first pulsate eliminator
37—second pulsate eliminator
38—first feed line into dynamic mixer
39—second feed line into dynamic mixer
40—dynamic mixer
41—driving means for dynamic mixer
42—drive spindle
43—first additive material supplier
44—second additive material supplier
45—third pump means
46—fourth pump means
47—feed line from first additive material supplier
48—feed line from second additive material supplier
49—third pulsate eliminator
50—fourth pulsate eliminator
51—third feed line into dynamic mixer
52—fourth feed line into dynamic mixer
53—first input port
54—second input port
55—third input port 56—fourth input port
57—input end of dynamic mixer
58—exit end of dynamic mixer
59—product delivery port
60—exude
61—butterfly valve first position
62—butterfly valve second position
63—sealant cartridge partially filled with exude
64—direction exude is moving
65—sealant cartridge waiting to be filled with exude
66—means for fastening three-way valve to dynamic mixer

DETAILED DESCRIPTION OF THE PREFERRED EMBODIMENTS

The process of the present invention is shown by the schematic drawing of FIG. 5 which illustrates the equipment and the process functions to provide a non-pulsating product exude. The general process involves the mixing of at least two pumpable feed materials which may be of similar viscosities or may be of different viscosities. One situation may involve highly viscous pumpable materials, such as a paste type material, a polymer-filler mixture, or what is sometimes referred to as a base material. In another situation, at least one highly viscous pumpable feed material and at least one low viscosity pumpable feed material, for example as one thinks of water as a low viscosity material, are mixed. The process of this invention is not intended to be limited to the above situations, but variations in pumpable materials from the highly viscous material to very low viscosity materials can be included. This process is required to continuously mix these materials, which may have nearly the same viscosities or which may have widely differing viscosities, they also need to be mixed to homogeneity throughout the mixing operation given the same feed materials. This means that neither the high viscosity material nor the low viscosity material can be allowed to vary in their feed ratio if an exude 60 is expected to be the same at the beginning of the process, during the process, and at the end of the process. If the feed ratio were to vary from time A to time B, as illustrated in FIG. 5, the resulting product would not be homogeneous and constant throughout the process operation. In other words, if the feed ratio varies because of pulsations in any feed, the resulting product will also exhibit variation. Although a cut of an exude at time A, may be homogeneous throughout the sample taken, it is highly unlikely that a cut of an exude at time B will have the same composition as the cut at time A if pulsations occur. For some mixing operations, variations cannot be tolerated. Therefore, the process of this invention eliminates at least two kinds of variations which may take place during an attempt to mix pumpable feed materials. One is the pulsating caused by the use of a means to force the material from the material supplier into the mixer. The other is the feed rate of each feed over a period of time.

The present process provides a means to independently balance the pressures and the volumes of pumpable feed materials entering the dynamic mixer. The pressure or force to push the material into the dynamic mixer will vary depending upon the viscosity of the pumpable feed material, the construction of the feed lines and their geometries, the pumps used and the pulsate eliminators used. The ability to regulate the pressure and the volume of each feed independently permits the delivery of the correct amounts and volumes of each feed material into the dynamic mixer at a constant rate and therefore at a constant volume ratio. This should also be a constant weight ratio because the density of a specific feed should not change during a continuous operation.

A preferred application of the process of the present invention is shown by the schematic drawing of FIG. 5 which illustrates the equipment and the process functions to provide a non-pulsating product exude. This preferred process involves the mixing of at least two pumpable materials of different viscosities where one is of high viscosity, such as a paste might be, and another is of low viscosity, such as one with a viscosity like that of water. This process not only is required to continuously mix these materials of widely differing viscosities, but they need to be mixed to homogeneity throughout the mixing operation given the same feed materials. This means that neither the high viscosity material nor the low viscosity material can be allowed to vary in feed ratio. It is particularly difficult to continuously mix a viscous material with a low viscosity material because the pressure used to transport the highly viscous material to the dynamic mixer is greater than the pressure to move a low viscosity fluid material to the dynamic mixer. In such a case, the viscous material may cause a blocking effect upon the low viscosity material and may force the low viscosity fluid back toward its material supplier unless there is a balance of pressures. If the feed ratio were to vary from time A to time B, the resulting product would not be homogeneous and constant throughout the process operation. In other words, if the feed ratio varies because of pulsations in any feed, the resulting product will also exhibit variation. Therefore, the present process overcomes both the pulsations normally observed when mixing two or more pumpable materials and eliminates feed volume variations which are more prone to occur when at least two of the feeds having different viscosities are attempted to be input into the dynamic mixer. To operate at a continuous mode, the ratio of the feeds must remain constant so that the resulting product will have the same concentration for each feed regardless of the length of time after start-up a sample is taken at the dynamic mixer exit end 58. To maintain a constant feed ratio, the pressures between the feeds are balanced. For example, the pressure of each feed at input ports 54, 55, 56, and 57 needs to be at least as great as the pressure in the dynamic mixer 40 of the mixing material in the mixer as a feed enters the mixer. The pressure balance is provided by regulating the pulsate eliminators which are illustrated in the drawing as 36, 37, 49, and 50.

Material suppliers 30 and 31 represent a device or container which provides a source of a specific material to be mixed in this process. The number of material suppliers can vary from two to as many as is practical. A material supplier may be a storage container such as a tank, a drum, a bottle and the like or it may be a continuous mixing device which is used to make a pumpable material for example a continuous screw mixer. A material supplier may be used for high viscosity materials, such as paste-like compositions, such as polymer and filler dispersions which are made in a separate operation, usually using high shear devices. The high shear devices used for such operations to make polymer and filler dispersions may be a batch mixer such as a dough mixer or a continuous screw mixer. To move high viscosity material from the material supplier to the dynamic mixer, a force is required, such as a pump 32 or 33. Pumps for moving highly viscous materials are known, such as a surface plate pump used for pumping materials from drums or pails. The supply of feed coming from a material supplier may be a high viscosity pumpable material, such as a paste-like sealant base. Such pumpable materials require a force to move them to a pulsate eliminator, as illustrate by 36 or 37, to the dynamic mixer 40. At least some of the force required is provided by a pump, such as 32 or 33 and some may be provided by a continuous mixer, like the screw mixer used to make mixtures of polymer and filler (which is sometimes referred to as a base, i.e. a sealant base).

However, pumps can provide the force necessary to push a feed 34 or 35 into the dynamic mixer 40 but they would do it with a pulsating action which translates to variation in the output product (the exude) and as such, the exude would not be homogeneous and constant over the process operation. To overcome this pulsating action, a pulsate eliminator 36 or 37 is required. These pulsate eliminators are those devices which remove the pulsations which are caused by the pumps. Devices which can be used are gear pumps or displacement pumps designed for metering. Different types of gear pumps are needed depending upon the viscosity of the pumpable material. For example, a high viscosity pumpable material needs a close tolerance gear pump while a low viscosity pumpable material needs a gear pump designed for low viscosity materials, such as may be use for pumpable additive feeds where the pulsate eliminators are illustrated by 49 and 50. Another type of pulsate eliminator is a displacement pump, sometimes known as a syringe pump. The preferred use of the displacement pumps is to have at least two pumps in arrangement such that one syringe pump is dispensing pumpable material through a feed line such as 38, 39, 51 or 52, into the dynamic mixer while another syringe pump is being filled from a pump such as 32, 33, 45 or 46. The syringe pumps are synchronized such that pumpable material is being fed into the feed lines at a constant pressure without interruptions from change over from one syringe pump to another. In synchronizing the syringe pumps, the change over is timed such that the syringe cavity being filled has completed its filling operation before the syringe pump dispensing pumpable material into a feed line is completely spent of material. The syringe pumps are known displacement pumps which are constructed with a material cavity, a plunger which is used to apply force to push material from the material cavity, an inlet port and an outlet port. These pulsate eliminators remove flow variations caused by a pump forcing the feed from a material supplier through the pulsate eliminator into the dynamic mixer and provide a continuous delivery of the feed materials through a first feed-line 38 or a second feed-line 39 to the dynamic mixer 40. The feed of high viscosity material to the dynamic mixer passes through input ports 53 and 54. It is these feeds which need to be constant and without pulsations in order to obtain a homogeneous and constant exude over the time period which the continuous process is operated. The dynamic mixer is energized through a driving means 41 through a drive spindle 42.

Additive material suppliers 43 and 44 are storage containers for low viscosity material, such as fluid additives or curing agents, or they supply material directly from a continuous manufacturing source of the additive material. As with high viscosity materials, low viscosity materials also need assistance (a force) to move them to the dynamic mixer, such as with pumps 45 or 46 through feed lines 47 or 48. As with high viscosity materials, these fluids would exhibit variation in the feed and therefore pulsate eliminators 49 and 50 are required to eliminate the pulsations of the feed into the dynamic mixer 51 and 52. These pulsate eliminators can be the same type as those used for the high viscosity materials, but those which are designed for particular viscosity ranges should be used. Low viscosity material enters the dynamic mixer through input ports 55 and 56. These feeds need to provide constant pressure and constant feed ratio without pulsation over the time period of continuous operation for any given product. The input ports 55 and 56 are shown somewhere along dynamic mixer 40, however, the exact point of input from feed lines 51 and 52 can be anywhere from the input end of the dynamic mixer 57 to a point as near the exit end of the dynamic mixer 58 as will permit a thoroughly mixed and homogeneous exude. The feed ratio of high viscosity material entering at input ports 53 and 54 and of the low viscosity material entering at input ports 55 and 56 should be constant over the duration of the continuous operation of the mixing process for one product production. The feed ratio should not be varied if one desires to obtain the same constant product coming out product delivery port 59.

The dynamic mixer is one which operates under low pressure. The feeds and the dynamic mixer are such that the pressure at input end 57 is less than 3.5 MPa. One such in-line dynamic mixer is a particularly useful one shown in FIGS. 1, 2, 3, and 4 which has folding elements and perforated plates. The process from material supplier to delivery port has a minimal transformation of mechanical energy to heat, is easy to assemble and disassemble, easy to clean, and has a minimal hold-up volume, which are important when changing feeds to make a new product.

This dynamic in-line mixer is made up of disconnectable mixing units as shown by FIG. 1, a partial cross section of two connected disconnectable mixing units and an end disconnectable mixing unit where 2 illustrates one such unit. Each disconnectable mixing unit comprises a casing 6 containing a chamber 8 and a chamber wall 7. The chamber is tubular in nature and its size is such that it can be connected with other disconnectable mixing units including an end disconnectable mixing unit 4 which varies from the other disconnectable mixing units in that it has a connection flange 5 for attachment to an inlet for one material to be mixed and a spindle driver 27.

In each disconnectable mixing unit, there is a spindle 12 which can be removably connected through male threaded spindle fasteners 13 to female threaded spindle fasteners 14 of another disconnectable mixing unit. Each disconnectable mixing unit has mixing means which are flywheels 10. There are at least two flywheels per disconnectable mixing unit. Each flywheel is spaced from the next flywheel along the spindle to provide an area in which there is at least one mounted post 20 which protrude into the chamber between the flywheels. There can be one or more such post between each pair of flywheels. The posts 20 are mounted to protrude into chamber 8 from chamber wall 7. For example, there may be four posts spaced approximately equidistance from each other around the casing and protruding into the chamber between a pair of flywheels. It is preferred to have at least four such posts between each pair of flywheels. These posts 20 may be attached to the casing by threaded means or may be welded into place or whatever other means is suitable. Using posts which are attached by threaded means allows each post to potentially become a feed line for adding other materials. This allows flexibility by interchanging a post for a feed line with an inlet port 18 as illustrated in FIG. 1. Each disconnectable mixing unit also contains a bulkhead assembly 15. This bulkhead increases the mixing operation and provides a homogeneous product exiting material exit end 29 throughout the continuous operation of this in-line dynamic mixer.

The bulkhead assembly 15 is shown in more detail from the end view in FIG. 2 and from the exploded cross section in FIG. 3. The bulkhead assembly is made up of a bulkhead 23 which contains bulkhead perforations 24. The number and size of perforations should be sufficient to allow the material to flow at an acceptable rate without being obstructive to the flow and without causing the shear to increase to an undesirable point. The bulkhead 23 is essentially stationary and is mounted such that a spindle bushing 16 is between bulkhead 23 and spindle 12. The spindle bushing allows the spindle to rotate while the bulkhead remains stationary. The bulkhead 23 is held in place essentially perpendicular to the spindle axis by washers 22.

The flywheel 10 is illustrated in FIG. 4 as the cross section at A—A' of a disconnectable mixing unit in FIG. 1. As shown, the flywheel has a folding recess 21 which can be the squared shape as shown or other shapes which can be curved instead of squared. This folding recess turns the material in a folding manner into the space between two flywheels where the post also cause a mixing action to take place. As the material flows through the chamber in direction 25, the spindle rotates, such as shown by 26. As the spindle rotates, the flywheels also rotate. At least one point on the flywheel at the longest radius from the spindle center, describes a rotational circumference which is in spaced relationship with the chamber wall such that the material flows through the chamber without high shear and in a continuous manner. The shape of the flywheel and the nature of the folding recess facilitates the cleaning operations of the mixer.

This in-line dynamic mixer is especially useful for mixing a viscous material entering through the end disconnectable mixer unit and a low viscosity fluid material entering through an inlet port from a feed line in one of the disconnectable mixer units. This mixer is readily varied to allow for many disconnectable mixer units such that many kinds of materials can be added along the length of this in-line dynamic mixer. This mixer can be used to pigment products, to introduce additives, and to add curing agents. A feature of this mixer is that it is useful for continuous operation in the production of homogeneous product exuding from the material exit end 29.

The exude exiting product delivery port 59 can be collected into a variety of storage containers. If a multi-way valve, for example a three-way valve as shown in FIG. 6 as a butterfly valve in two positions a first position 61 and a second position 62, is attached to the product delivery port 59 by a fastening means 66. The continuous process of mixing at least two pumpable materials is therefore attached to a discontinuous process, i.e. the rapid filling of exude 60 into sealant cartridges. FIG. 6 shows a sealant cartridge 63 which is partially filled with exude and a sealant cartridge 65 which is waiting to be filled with exude. Butterfly valve in the first position 61 allows the exude to flow in direction 64 filling sealant cartridge 63 while at the same time permitting a sealant cartridge to be placed in the position shown by sealant cartridge 65 which is waiting to be filled with exude. When the butterfly valve is moved to the second position 62, sealant cartridge 65 is then filled with exude. The filling of cartridges and movement of the butterfly valve to accomplish this process is synchronized so that the exude exiting product delivery port 59 is maintained at a constant and continuous rate. As the butterfly valve moves from first position 61 to second position 62, the exude entering into sealant cartridge 63 has the flow reduced at the same rate as the flow increases into sealant cartridge 65. This process of filling sealant cartridges as illustrated in FIG. 6 can be automated. Instead of a butterfly valve, one can use a full bore ball valve. In this process, each sealant cartridge will contain a consistent product and with the ability to fill the cartridges by an automated process the customers obtain the same product cartridge after cartridge at a reduced cost.

While the invention is described in connection with a preferred process, it will be understood that it is not intended to limit the invention to that process. On the contrary, it is intended to cover all alternatives, modifications, and equivalents as may be included within the spirit and scope of the invention as defined by the appended claims.

That which is claimed is:

1. A process comprising continuously displacing with pulsating movement created by a force means from at least two material suppliers, pumpable feed material from each material supplier through respective pulsate eliminators into a dynamic mixer having an input end and an exit end wherein the pressure at the input end is less than 3.5 MPa, and thereby continuously combining at least two pumpable feed materials in a predetermined volume ratio to provide a thoroughly mixed product which is being continuously exuded from the exit end of said dynamic mixer at a constant volume flow and said product exiting the dynamic mixer being of constant composition throughout the time the process is operated given the pumpable feed materials are constant and the predetermined volume ratio of pumpable feed materials is constant, continuously passing the mixed product exude from the exit end of the dynamic mixer through a multi-way valve attached to the exit end of the dynamic mixer, and filling storage containers.

2. The process according to claim 1 in which the multi-way value is a three-way valve and the storage container are sealant cartridges.

3. The process according to claim 2 in which the three-way value is a butterfly valve.

4. A process comprising continuously displacing with pulsating movement created by a pump means from at least one material supplier, a high viscosity material through a first pulsate eliminator into a dynamic mixer having an input end and an exit end wherein the pressure at the input end is less than 3.5 MPa, and continuously displacing with pulsating movement created by a pump means from at least one additive material supplier, a low viscosity material through a second pulsate eliminator into said dynamic mixer through an input port positioned at a point between the input end and the exit end thereby continuously combining the high viscosity material and the low viscosity material to provide a thoroughly mixed product which is being continuously exuded from the exit end of said dynamic mixer at a constant volume flow and said product exiting the dynamic mixer being of one constant composition throughout the process operation, continuously passing the mixed product exude from the exit end of the dynamic mixer through a multi-way valve attached to the exit end of the dynamic mixer, and filling storage containers.

5. The process according to claim 4 in which the multi-way value is a three-way valve and the storage container are sealant cartridges.

6. The process according to claim 5 in which the three-way value is a butterfly valve.

* * * * *